US005306199A

United States Patent [19]

Locricchio

[11] Patent Number: 5,306,199

[45] Date of Patent: Apr. 26, 1994

[54] MANUALLY ACTUATED TOY DINOSAUR STRUCTURE AND METHOD

[76] Inventor: Salvatore Locricchio, 4559 Essex Ct., Sterling Hts., Mich. 48310

[21] Appl. No.: 307,540

[22] Filed: Feb. 8, 1989

[51] Int. Cl.[5] ..... A63H 7/00

[52] U.S. Cl. ..... 446/177; 446/362; 446/317; 74/479 BF

[58] Field of Search ..... 446/177, 361, 362, 363, 446/365, 331, 317, 30, 31, 356; 74/502.1, 479 BF

[56] References Cited

U.S. PATENT DOCUMENTS

| | | | |
|---|---|---|---|
| 1,396,321 | 11/1921 | Coleman | 446/317 |
| 1,601,983 | 10/1926 | Savage | 446/362 |
| 2,404,922 | 7/1946 | Padgett . | |
| 2,453,571 | 11/1948 | Barbieri et al. . | |
| 2,507,053 | 5/1950 | Rymer . | |
| 2,543,965 | 3/1951 | Hamilton . | |
| 2,602,604 | 7/1952 | Russell et al. . | |
| 2,765,128 | 10/1956 | Barth . | |
| 3,058,260 | 10/1962 | Sanborn . | |
| 3,061,972 | 11/1962 | Wigal . | |
| 3,503,152 | 3/1970 | Aoki et al. . | |
| 3,882,632 | 5/1975 | Quinzer . | |
| 4,007,646 | 2/1977 | De Jonge . | |
| 4,072,065 | 2/1978 | Perrella | 74/502.1 X |
| 4,162,589 | 7/1979 | St. Clair . | |
| 4,258,500 | 3/1981 | Anderson | 446/177 |
| 4,268,125 | 5/1981 | Carter | 74/502.1 X |
| 4,333,259 | 6/1982 | Lin | 446/177 |
| 4,476,650 | 10/1984 | Lokvig | 446/362 |
| 4,921,293 | 5/1990 | Ruoff et al. | 74/479 BF X |

FOREIGN PATENT DOCUMENTS

| | | | |
|---|---|---|---|
| 135872 | 3/1920 | United Kingdom | 446/356 |
| 657992 | 10/1951 | United Kingdom | 446/362 |

*Primary Examiner*—Mickey Yu

[57] ABSTRACT

Manually actuated toy dinosaur structure and method. The dinosaur structure includes a rigid body member, a head positioned on the body member, structure for lowering a lower jaw and then turning the head to one side, two legs having suction cup feet and ankle portions, structure for first releasing suction in the suction cups and then moving the legs to produce walking of the toy, a tail, and means for moving the tail. The method includes the steps of selectively actuating finger trigger members on a cable control member to selectively produce first opening of the lower jaw of the dinosaur followed by turning of the dinosaur's head to one side, alternately breaking the suction cup seal on one of the leg portions followed by lifting of the leg portion and subsequent returning of the leg portion to its initial position and to cause the dinosaur toy to appear to walk, and moving of the tail transversely over center. A hand control is provided to actuate the head, legs and tail of the dinosaur toy through flexible cables and includes trigger structures held in relatively fixed rotatable positions with actuation being on axial movement thereof. A cable tube guides control cables between the cable control and the toy.

7 Claims, 2 Drawing Sheets

FIG. 2
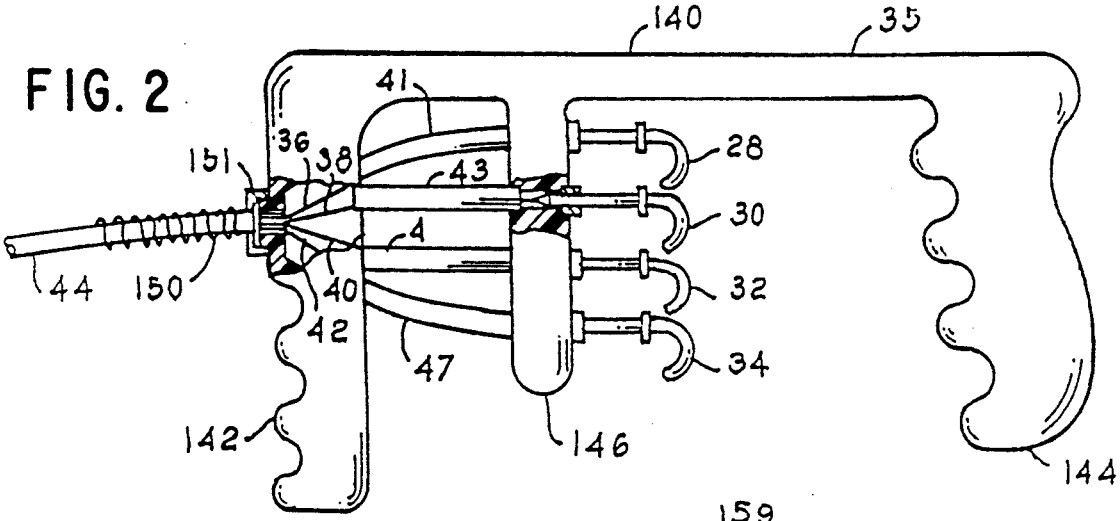
FIG. 3
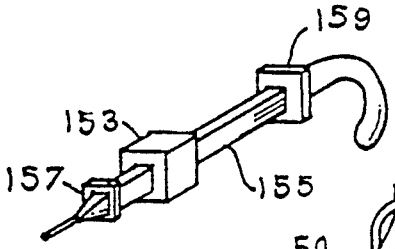
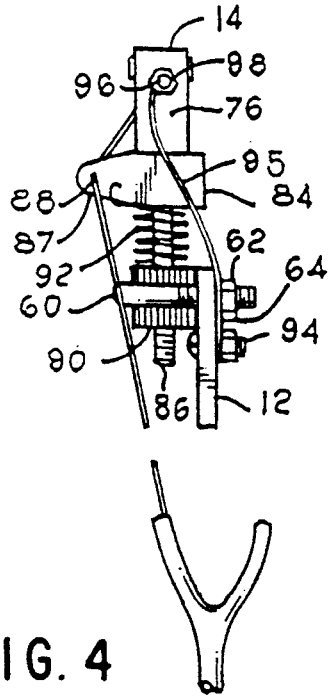
FIG. 4
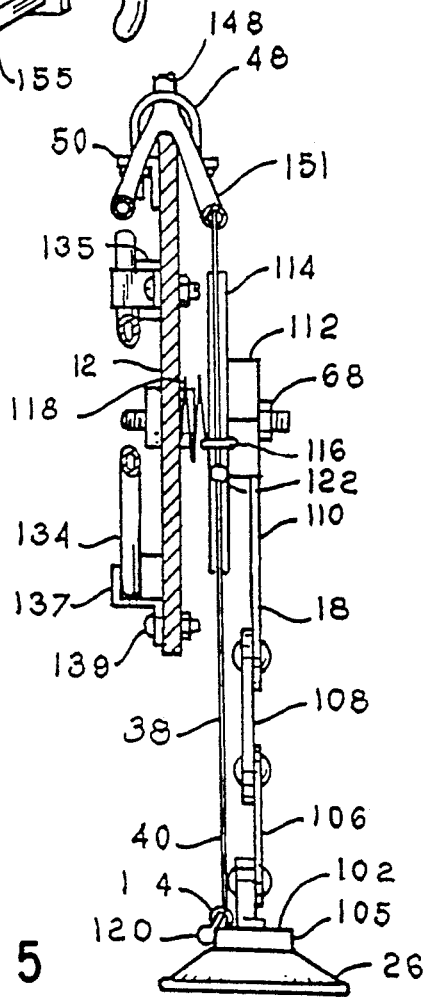
FIG. 5

MANUALLY ACTUATED TOY DINOSAUR STRUCTURE AND METHOD

BACKGROUND OF THE INVENTION

1. Field of the Invention

The invention relates to manually actuated mechanical devices having a plurality of moving parts and the method of moving the moving parts, and refers more specifically to toy dinosaur structure having a head with a movable lower jaw, legs including suction cup foot and ankle portions, and a tail, all controlled from a hand held cable control through a plurality of selectively operable control cables.

2. Description of the Prior Art

In the past, manually actuated structures such as model airplanes, wall crawling toys and the like have been known which have included control cables for actuating the movable portions thereof through a hand control and/or suction cup holding devices.

Such prior devices as are known have not included control cables extending through an axially rigid sheath which is transversely flexible, located between the devices and a hand control therefor, by which the control cables may be selectively tensioned and/or relaxed.

Thus, model airplane control has usually been accomplished by means of flexible lines or cables which are maintained in tension during operation of a model airplane. Such control lines normally operate by pivotal movement of a centrally pivoted lever having cables connected to each end thereof by which one cable is caused to appear lengthened and the other cable appear to be shortened at the model airplane. Such controls are limited in application, in the number of cables which a single individual can effectively control without overly complex controls, and generally restrict the movement of the model airplane to a circle with the operator of the model airplane in the center of the circle.

Wall climbing and walking toys of the past utilizing suction cup devices for attachment to smooth surfaces have often not provided means for specific breaking of the vacuum in the suction cups prior to movement of the parts of the devices to which the suction cups are secured. Such devices of the past have seldom provided specifically controlled multiple movements of a single part associated with the suction cup.

Tail movement or wagging structure of the past wherein an articulated tail is moved horizontally selectively over center are unknown. In particular, tails of toy animals which are constructed of a plurality of portions pivotally connected together for horizontal movement and which are biased into a straight line by a coil spring extending therethrough with weighted ends whereby movement of the tails past a straight position is accomplished through momentum of the weights and action of the coil springs on actuation of the tails, are not believed to be found in the prior att.

SUMMARY OF THE INVENTION

The invention is a manually actuated mechanical device having a plurality of moving parts, which parts are movable in response to tensioning and relaxing of a plurality of control cables extending between a hand held cable control and the device through a cable tube which is transversely flexible but which is not substantially compressible or extensible longitudinally. The cable control includes a plurality of non rotatable trigger structures, each connected to a separate control cable for movement of a separate part of the device, which are selectively actuable by the fingers of an operator's hand. In one embodiment of the invention, the device is a toy dinosaur, the moving parts are the head, tail and legs, and separate actuating cables are provided for the head, each of the two legs, and the tail.

According to the method of the invention, the head may be selectively caused to lower its lower jaw and turn to the side in one direction. The legs may each separately, selectively be pivoted to raise the suction cup foot and ankle portions and subsequently be lowered into the same relative position with respect to the rest of the device after suction has first been broken at the suction cup whereby alternate breaking of the suction and raising and lowering the legs on opposite sides of the dinosaur structure produces a walking movement due to interaction of the legs, torsion springs therein and manipulation of the control cables for the legs as will be considered in more detail herein after. Further, in accordance with the method of the invention, the tail is caused to move back and forth in a substantially horizontal plane on tensioning and relaxing of one of the control cables selectively and is caused to move past a center or straight position due to the momentum of a weight positioned in the end of the tail.

BRIEF DESCRIPTION OF THE DRAWINGS

FIG. 2, is an elevation view of the cable control of the invention, constructed to effect the method of the invention.

FIG. 3, is a perspective view of a portion of one of the trigger structures of the cable control shown in FIG. 2.

FIG. 4, is a partial, elevation view of the mechanical actuating structure of the head of the toy dinosaur structure shown in FIG. 1, taken substantially in the direction of arrow 4 in FIG. 1.

FIG. 5, is an elevation view of one of the mechanical actuating structures of a leg of the toy dinosaur illustrated in FIG. 1, taken substantially on the line 5—5 in FIG. 1.

DESCRIPTION OF THE PREFERRED EMBODIMENT

Figure 1:
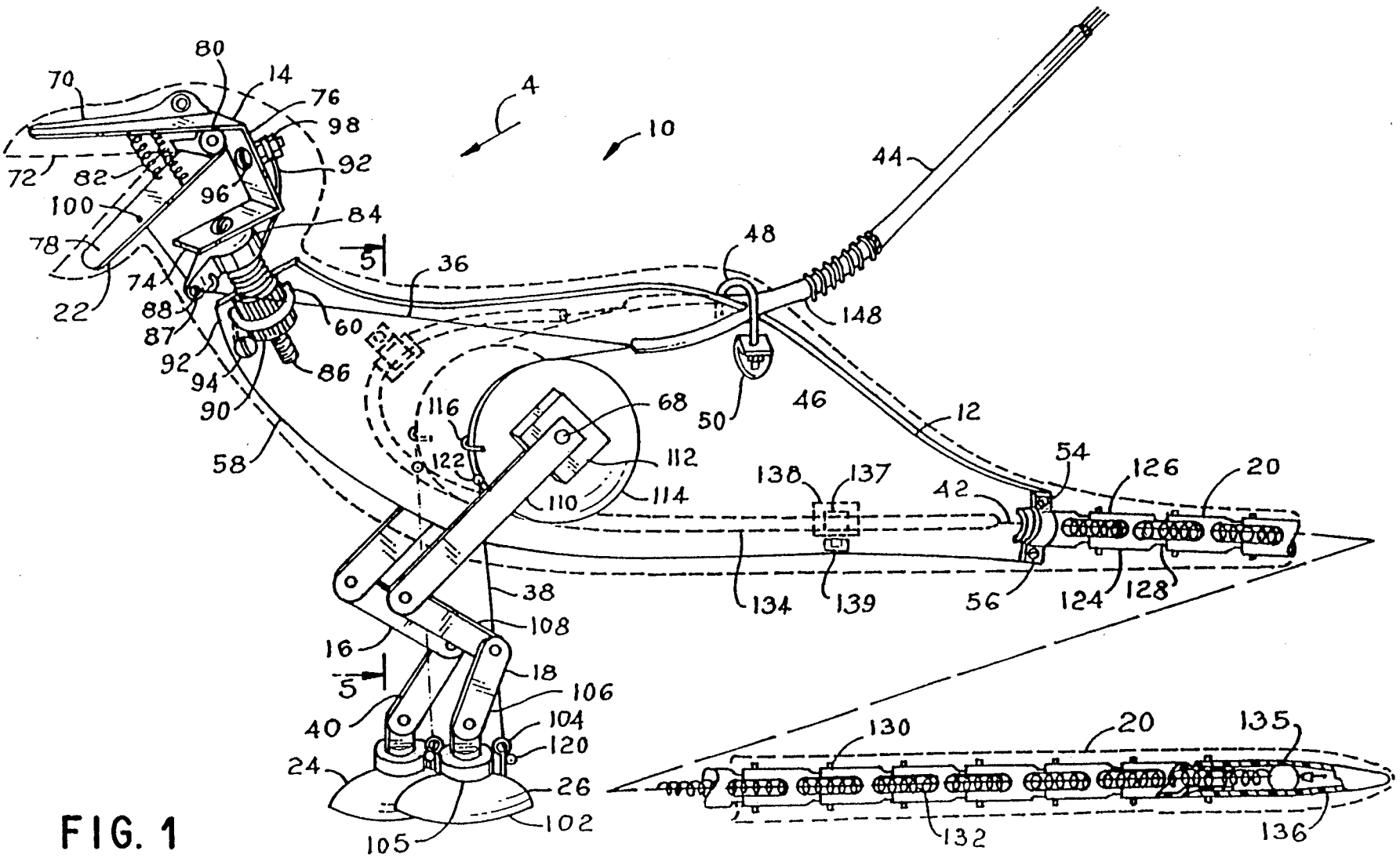
FIG. 1, is a partial, broken perspective view of the manually actuated mechanical toy dinosaur structure of the invention, operable in accordance with the method of the invention.

As shown best in FIG. 1, the device 10 of the invention is a toy dinosaur. The toy dinosaur 10 includes a body member 12, head structure 14, leg structures 16 and 18, and tail structure 20.

In accordance with the method of the invention, the head structure 14 includes a lower jaw 22 which may be selectively lowered to simulate opening of the mouth of the toy dinosaur 10. Further, the head structure 14 may be turned to one side following lowering of the lower jaw 22. The leg structures 16 and 18 may alternately be rotated clockwise as shown in FIG. 1, and returned to their original position relative to the body member 12 following a breaking of the seal of the suction cup ankle and foot portions 24 and 26 respectively to simulate walking of the dinosaur. Finally, the tail structure 20 may be moved horizontally from side to side selectively.

Movement of the head structure 14, leg structures 16 and 18, and tail structure 20 is selectively accomplished by manual manipulation of finger trigger structures 28, 30, 32 and 34 of the cable control structure 35, best shown in FIG. 2. The individual finger trigger structures 28, 30, 32 and 34 control tensioning and relaxing of control cables 36, 38, 40 and 42, connected as shown through guides 41, 43, 45 and 47 to the individual finger trigger structures 28, 30, 32 and 34 respectively.

A cable tube 44 is connected between the cable control structure 35 shown in FIG. 2 and the toy dinosaur shown in FIG. 1, through which the control cables 36, 38, 40 and 42 extend. The cable tube 44 is flexible transversely but is substantially non flexible or rigid longitudinally. That is to say, the length of the cable 44 does not change, but portions of the cable are movable relative to each other transversely along the longitudinal axis of the cable.

More specifically, the body member 12 of the dinosaur toy 10 is a substantially flat, planar member and may be constructed of a plurality of materials such as wood, plastic, metal, etc. The cable tube 44 is secured to the body member 12 by convenient means such as an L shaped bracket 46, secured to each side of the body member 12 by convenient means such as adhesion, soldering or welding, or the like in conjunction with the U bolt 48 and nuts 50. Similarly, the tail structure 20 may be connected to the body member 12 by a bracket 52 on one side of the body member 12 in conjunction with the U bolt 54 on the back side of the body member 12 and nuts 56, again as shown best in FIG. 1. The head structure 14 is similarly secured to the front end 58 of the body member 12 of the dinosaur toy 10 by a U bolt 60 extending through the body member 12 and secured on the back side of the body member 12 as shown in FIGS. 1 and 4 by a strap 62 and nuts 64. As shown best in FIGS. 1 and 5, the leg structures 16 and 18 are secured to the body member centrally thereof by means of the nut 66 and the threaded shaft 68 extending through the nut 66. The nut 66 is again secured within the body member 12 by convenient means such as an adhesive, soldering, welding or the like.

The head structure 14 specifically includes a U or a J shaped member 70 having leg 72 and 74 and connecting portion 76 extending therebetween. Leg 72 forms the upper jaw of the dinosaur head structure 14. A lower jaw member 78 is hinged to the upper jaw member 72 at the connection thereof with the connecting portion 76 by hinge structure 80. The lower jaw member 78 is biased clockwise into a relatively closed position by means of the springs 82 extending between the leg 72 and lower jaw member 78. The J shaped member 70 is rigidly secured to an idler arm having the offset portion 87 thereon with a hole 88 therein displaced to one side of the body member 12, as shown best in FIG. 4. The idler arm 84 and J shaped member 70 are mounted for rotation about the axis of a bolt 86. Bolt 86 extends through the nut 90 held in fixed position on the body member 12 by the U bolt 60. A torsion spring 92 is sleeved over the bolt 86, one end of which is connected to the idler arm 84 and the other end of which is secured to the nut 90. Torsion spring 92 tends to return the head structure 14 to a straight ahead position as shown in FIG. 1 on relaxing of actuating cable 36, as will be seen subsequently.

The initial position of the head structure 14 is determined by the S shaped spring member 95, shown in FIGS. 1 and 4, having a lower end connected to the end 58 of the body member 12 by means of the bolt and nut 94 and an upper end secured to the connecting portion of the J shaped member 70 by means of the bolt 96 and nut 98.

As shown, the actuating cable 36 extends from the trigger structure 28 through the cable tube 44 through the opening 88 in the idler arm 84, and is connected to the lower jaw 78 by connector 100, as shown best in FIG. 1.

The leg structures 16 and 18 are identical; accordingly, only one leg structure, 18, will be considered in detail. Leg structure 18 is shown best in FIGS. 1 and 5. Leg structure 18 includes a suction cup foot and ankle portion 102 having an eyelet 104 connected to the top thereof adjacent its outer periphery, an ankle weight 105 and a plurality of leg links 106, 108, and 110 rigidly connected together in the configuration shown in FIG. 1. The upper leg link 110 is rigidly connected to the square hub 112 of pulley 114, as shown best in FIG. 1 The pulley 114 is rotatably mounted on the shaft 68 as shown best in FIG. 5 and includes a U shaped eyelet 116, secured to the periphery thereof. A torsion spring 118 is provided acting between the body member 12 and the pulley 114 to return the pulley 114 to a home position on release of cable 39. Cable 39 is passed around pulley 114 through eyelet 116, through eyelet 104, and is connected to a ball stop 120 at one end thereof. A second ball stop 122 is provided on the cable 39 adjacent eyelet 116. The function of the eyelets 104 and 116 with the ball stops 120 and 122 will be considered subsequently in conjunction with the operation of the dinosaur toy 10. The ankle weight assures sealing of the suction cup 26 to a smooth surface.

The tail structure 20 includes a plurality of cylindrical links 124 having overlapping tabs 126 and 128 on opposite ends thereof, which are pivotally connected together, permitting the separate links 124 to pivot horizontally about the pivot structures 130. Spring means 132 is passed centrally through the tail structure 20 and tends to bias the tail structure 20 straight. Control cable 42 is passed through a reversing tube 134 spaced slightly from the body member by spacers 135 and secured to the body member 12 by convenient means such as Z-shaped clamps 137 and nut and bolt structures 139, as shown, and extended through the tail 20. The end of control cable 42 is connected to a weight 135 provided in the end 136 of the tail structure 20 as shown best in FIG. 1. The function of the weight 135 will be considered along with the operation of the dinosaur toy 10 subsequently.

The cable control 35 for the dinosaur toy shown best in FIG. 2 includes the front hand grip 142 as shown in FIG. 2, a rear hand grip 144 which as shown is shorter than the front hand grip 142, and a connecting portion 140 extending therebetween. A trigger structure bracket 146 extends downwardly from the connecting portion 140 of the control cable 35, as shown best in FIG. 2, and a plurality of trigger structures 28, 30, 32 and 34 are secured to the trigger bracket 146. As shown best in FIG. 3, each of the trigger structures 28, 30, 32 and 34 includes a non circular guide 153, which as shown is square, secured to the trigger guide 146, through which a square portion 155 on each of the trigger structures extends. Such structure prevents rotation of the trigger structures 28, 30, 32 and 34 to facilitate grasping and manipulation thereof. The inner ends of the trigger structures 28, 30, 32 and 34 as shown are connected to ends of the separate cable controls 36, 38, 40 and 42. Again, the cables 36, 38, 40 and 42 extend through guides 41, 43, 45 and 47 and the cable tube 44 and are tensioned on movement of the trigger structures 28, 30, 32 and 34 toward the hand grip 144 and are relaxed on releasing of the trigger structures 28, 30, 32 and 34. Square stops 157 and 159 are provided at each end of the square portions 155 of the trigger structures to prevent disengagement of the square portions of the trigger structures from the non circular guide 153 therefore.

The cable tube 44 is similar to cable tubes utilized on mountain bikes for control cables, and as shown is provided with a split portion 151 adjacent the end 148 thereof whereby two control cables, that is control cables 40 and 42, are passed behind the body portion of the dinosaur structure 10 as shown best in FIG. 1, while the two control cables 28 and 30 are passed in front of the body portion 12 of the dinosaur toy 10, as shown in FIG. 1. As pointed out above, the lower end 148 of the cable tube 44 is secured to the body member 12 of the dinosaur toy by brackets 50, U bolt 48, and nuts 46. Similarly, the upper end of the cable tube 44 is secured to the cable control 35 by convenient means such as a screw thread on the cable control 35 and a cup shaped coupler 151 on the end 150 of the cable tube 44. As shown, the control cables 36, 38, 40 and 42 connected to the selectively operable trigger structures 28, 30, 32 and 34 pass through the guides 41, 43, 45 and 47 and the front hand grip 142 of the hand control 35 into the end 150 of the cable tube 44 into the separate portions of the lower end 148 of the cable tube 44 and are connected ultimately to the head, legs and tail of the dinosaur toy 10, as indicated above.

As shown in dotted outline in FIG. 1, the body member 12, head, leg and tail structures may be covered with suitable material such as foamed plastic, molded and colored to give accurate form to the dinosaur 10.

In overall operation of the dinosaur toy 10, as shown best in FIG. 1, the cable control structure of FIG. 2 is gripped with, for example, the left hand of an operator who is right handed, grasping the hand grip 142, and with the right hand of the operator grasping the hand grip 144 with the ends of the operator's fingers on the trigger structures 28, 30, 32 and 34, preparatory to pulling the trigger structures toward the hand grip 144. The dinosaur toy 10 is positioned on a smooth surface such as on a table or the like, and is held in place by the grip of the suction cup feet and ankle portions 24 and 26 thereof, and to some extent by the tail 20 and/or the cable tube 44.

On pulling of the first trigger structure 28, the cable 36 is tensioned to first draw the lower jaw 78 of the dinosaur toy 10 downward against the bias of the relatively light springs 82. At the point of maximum opening of the jaw 78, further tension on the cable 36 will cause rotation of the idler arm 86 counter-clockwise as shown in FIG. 1 to cause rotation of the head to one side. On release of the trigger structure 28, the head 14 will be caused to return to its straight ahead position by the torsion spring 95. The jaw will close due to the bias of the springs 82 to complete the movement of the head structure 14.

On tensioning the cable 38 through pulling of the trigger structure 30, cable 38 first moves over pulley 114 to place the ball stop 120 against eyelet 104 and subsequently break the vacuum beneath the suction cup 26. On further pulling of the cable 38, the ball stop 122 engages the eyelet 116 on the pulley 114 and the pulley 114 is rotated clockwise as shown in FIG. 1. Clockwise rotation of the pulley 114 as shown in FIG. 1 produces clockwise rotation of the rigidly connected leg links 106, 108 and 110 to raise the leg structure 18 and remove the suction cup 26 from the flat surface. On subsequent release of the trigger structure 30, the leg structure 18 is caused to rotate counterclockwise by the torsion spring 118 to return the leg structure 18 to its initial position relative to the dinosaur toy 10 when the cable 38 is fully relaxed.

Subsequent pulling and releasing of the trigger structure 32 to tension and relax the control cable 40 will cause a similar operation of the leg structure 16. Alternate actuation of the trigger structures 30 and 32 will produce forward walking of the dinosaur toy 10 over a flat surface.

In producing such walking, the leg structures are allowed to return to their full original positions only after the opposite leg structures have started to raise. Thus, a full step will be effected by the dinosaur toy 10 by first breaking the suction seal on one leg structure and then pivoting it clockwise as shown in FIG. 1, subsequently the control cable for the one leg is relaxed to permit partial return of the one leg to its original position. The one leg is returned about 85% and the suction cup again grips the smooth surface on which the toy 10 is positioned. The other leg is then lifted following breaking of the suction beneath its suction cup. During lifting of the other leg, the one leg is returned to its full previous position (about 15% additional movement), thrusting the toy 10; forward to complete one full step with the one leg structure.

Pulling of the trigger structure 34 will provide tension in the control cable 42, and a curling or shortening of the portion of the cable within the tail structure 20, to cause the tail to appear to move to one side or the other. Subsequent release of the trigger structure and relaxing of the cable 42 will cause the tail structure 20 to straighten out under bias of the spring 132. The tall structure 20 will pass over center during its straightening process due to the inclusion of the weight 136 in the end thereof, which provides momentum over center of the tail 20 through the momentum of the weight 136. Alternate pulling and releasing of the trigger 34 will thus produce a whipping or wagging of the tail structure 20 on a horizontal plane.

While one embodiment of the present invention has been considered in detail, it will be understood that other embodiments and modifications are contemplated by the invention. For example, the control structure of the invention is not limited to use with a dinosaur toy, or any toy. It is the intention to include all such embodiments and modifications as are defined by the appended claims within the scope of the invention.

What is claimed is:

1. A manually actuable toy dinosaur mechanical device comprising a plurality of separately movable parts, at least some of which movable parts are legs of the dinosaur, which legs have feet and ankle portions, which feet and ankle portions are suction cups, means for moving each dinosaur leg portion, a cable control including selectively manually actuable triggers, a single laterally flexible cable tube which is substantially rigid longitudinally, and a plurality of separate control cables including one cable passing from each of the movable parts of the device through the cable tube to a specific trigger for producing movement of the parts on actuation of the triggers, wherein the means for moving each dinosaur leg portion comprises means for first breaking the suction on the associated suction cup, and then means for rotating the leg portion on selective tensioning of the control cables, and bias means for subsequently returning the leg portion to its initial position on relaxing of the one control cable, and wherein the control cable for each dinosaur leg portion extends from a specific trigger structure to which one end of the control cable is attached, through the flexible cable tube to the means for first breaking the suction on the associated suction cup to which the other end of the control cable is attached, through the means for rotating the leg portion with which an intermediate portion of the control cable is operably associated.

2. Structure as set forth in claim 1 wherein the one end of the one control cable is rigidly secured to the specific trigger structure.

3. Structure as set forth in claim 1 wherein the other end of the one control cable is loosely secured to the means for first breaking the suction on the associated suction cup.

4. Structure as set forth in claim 3 wherein the means for first breaking the suction on the associated suction cup comprises: an eyelet rigidly secured to the suction cup adjacent its outer periphery through which the other end of the one control cable extends, and a stop member which is too large to pass through the eyelet is rigidly attached to the other end of the one control cable.

5. Structure as set forth in claim 1 wherein the intermediate portion of the one control cable is loosely secured to the means for rotating the leg portion.

6. Structure as set forth in claim 5 wherein the means for rotating the leg portion comprises: a pulley wheel secured to the leg portion for rotation therewith over which the one cable extends, an eyelet on the outer periphery of the pulley wheel through which the one cable extends, and a stop member which is too large to pass through the eyelet rigidly attached to the one cable adjacent the eyelet on the pulley wheel.

7. Structure as set forth in claim 1 wherein the means for moving each dinosaur leg portion comprises: the one control cable rigidly connected at one end to one of the triggers, the means for first breaking the suction on the associated suction cup comprises a first eyelet rigidly secured adjacent the outer periphery of the associated suction cup through which the other end of the one control cable extends and a first stop member secured to the one end of the one control cable which is too big to pass through the first eyelet; the means for rotating the leg portion comprises a pulley wheel secured to the dinosaur leg portion for rotation therewith around a portion of which an intermediate portion of the control cable extends, a second eyelet secured on the periphery of the pulley wheel through which the control cable extends, and a second stop member secured to the control cable adjacent the second eyelet and wherein the first stop member is secured to the other end of the control cable closer to the first eyelet than the second stop member is to the second eyelet, whereby on tensioning the control cable with the specific trigger associated therewith, the first stop member engages the first eyelet before the second stop member engages the second eyelet.

* * * * *